US005505457A

United States Patent [19]

Boylan et al.

[11] Patent Number: 5,505,457

[45] Date of Patent: Apr. 9, 1996

[54] METHOD OF PLAYING A DICE WAGERING GAME SIMULATING BOWLING

[75] Inventors: Eugene B. Boylan, Minden; Robert F. Koerner, Gardnerville; Russell R. Hebert, Carson City, all of Nev.

[73] Assignee: BET Technology, Inc., Carson City, Nev.

[21] Appl. No.: 417,221

[22] Filed: Apr. 5, 1995

[51] Int. Cl.[6] ..... A63F 9/04

[52] U.S. Cl. ..... 273/274; 273/277

[58] Field of Search ..... 273/146, 277, 273/298, 274

[56] References Cited

U.S. PATENT DOCUMENTS

| | | | |
|---|---|---|---|
| 5,308,081 | 5/1994 | Bartle | 273/274 |
| 5,350,175 | 9/1994 | DiLullo et al. | 273/146 |

OTHER PUBLICATIONS

The Ultimate 3–Roll Dice Game Survival Dice Article.

*Primary Examiner*—Benjamin H. Layno
*Attorney, Agent, or Firm*—Larson and Taylor

[57] ABSTRACT

A method of playing a wagering game is provided where an outcome is determined by a random value symbol generator actuatable by a player. The method of play simulates the game of bowling. First and second predetermined range of values are selected by a house, and a round of the game is played by the player beginning with the wagering of a wager that a first generation of the value symbol will be within the first predetermined range of values or that a second generation of the value symbol when added to the first generated value symbol will be within the second predetermined range of values. The player then activates the random value symbol generator to produce a first value symbol, and then activates the random value symbol generator to produce a second value symbol where the first value symbol is not within the first predetermined range of values. Where the second value symbol is generated, the value of the first value symbol and the second value symbol are added together to generate a sum. Finally, settling of the wager occurs. Preferably, the wagering game further includes continuing a turn of the player by playing another round where the first value symbol is within the first range or the sum of the first and second value symbols is within the second range and the wagering that the player will play a predetermined number of consecutive rounds and/or will generate a first value symbol in the first range for a predetermined number of consecutive rounds.

19 Claims, 1 Drawing Sheet

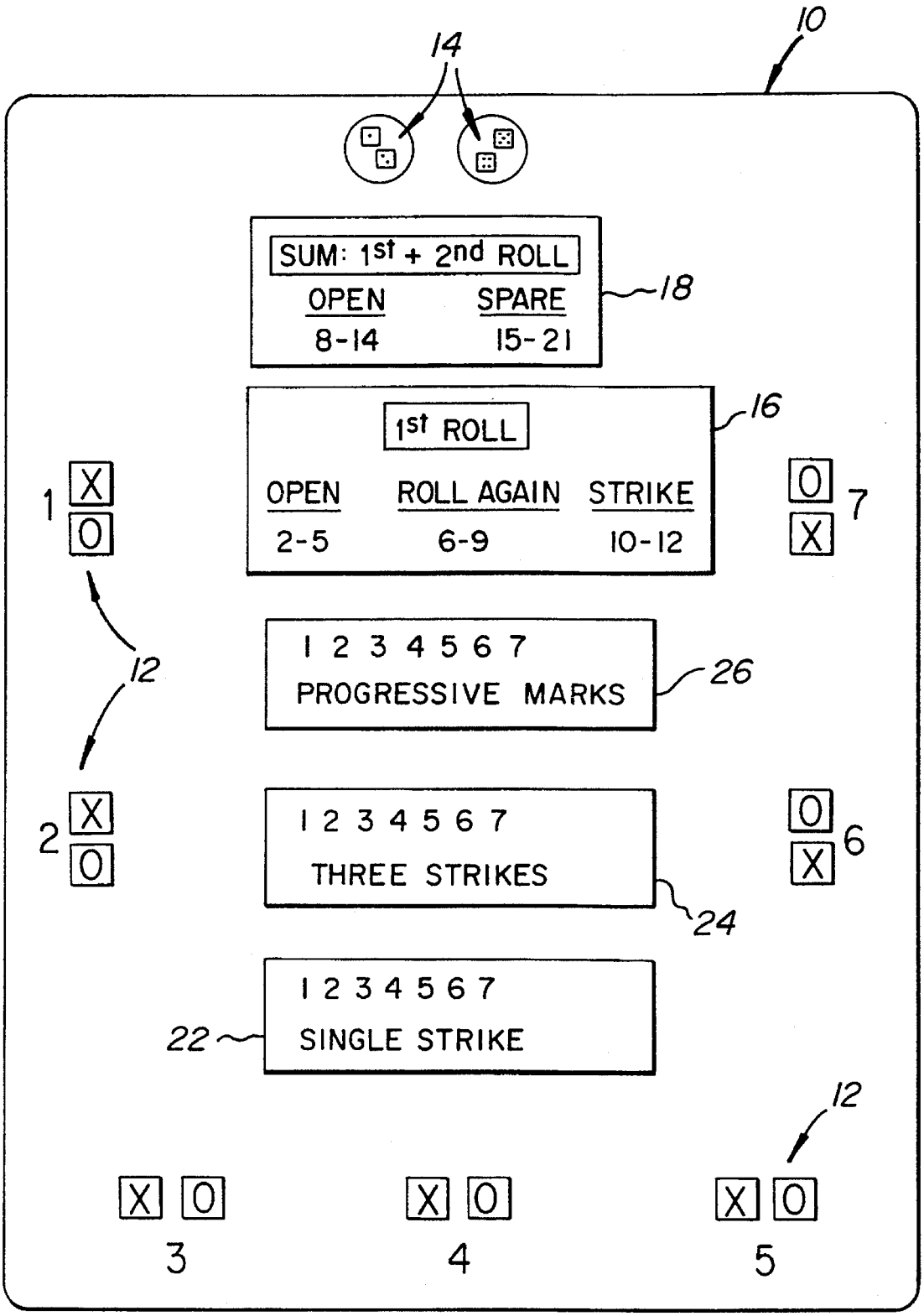
10
14
SUM: 1st + 2nd ROLL
OPEN
8-14
SPARE
15-21
18
1st ROLL
OPEN
2-5
ROLL AGAIN
6-9
STRIKE
10-12
16
1
X
O
7
O
X
12
1 2 3 4 5 6 7
PROGRESSIVE MARKS
26
2
X
O
1 2 3 4 5 6 7
THREE STRIKES
24
O
X
6
1 2 3 4 5 6 7
SINGLE STRIKE
22
12
X O
3
X O
4
X O
5

METHOD OF PLAYING A DICE WAGERING GAME SIMULATING BOWLING

FIELD OF THE INVENTION

The present invention relates generally to wagering games where an outcome of the game is determined by randomly generated value symbols, and more particularly to a wagering game where the player actuates a random value symbol generator once or twice each round with any two value symbols in a round added together to determine the outcome.

BACKGROUND OF THE INVENTION

Since the introduction of dice games in the U.S. in the early 1800's, such dice games have grown to be one of the most popular forms of gambling. "Craps" is certainly one of the most popular dice games, and this game derives it popularity from the player interaction with the dice and the relative low "house" advantage. However, there is a growing segment of the gaming public that perceives "craps" as a complicated game and therefor will not strive to learn how to play it. For that reason, simpler dice wagering games which will be more easily understood are desirable.

Another wagering dice game is called SURVIVAL DICE™. In this game, a player rolls three pairs of dice with the sum of all three rolls determining the outcome of an "ante" wager on the game. However, if specified sums are achieved after any roll, the wager is lost. Besides the "ante" wager, other wagers can also be made on the outcome of the first roll of a pair of dice, such as a specified high roll value(s), a specified low roll value(s), and/or double values.

While various dice games have been tried in the past, there is still a need for a dice game which is quickly and easily understood, and which allows the players to participate in the throwing of the dice.

SUMMARY OF THE INVENTION

In accordance with the present invention, a method of playing a wagering game where an outcome of the game is determined by randomly generated value symbols is provided. Initially, a random value symbol generator is provided which is actuatable by the player and which produces a value symbol within a predetermined set of values. In addition, a first predetermined range of values and a second predetermined range of values are selected. A round of the game is then played by the player beginning with the wagering of an ante wager that a first generation of the value symbol will be within the first predetermined range of values or that a second generation of the value symbol when added to the first generated value symbol will be within the second predetermined range of values. Next, the player activates the random value symbol generator to produce a first value symbol, and then activates the random value symbol generator to produce a second value symbol where the first value symbol is not within the first predetermined range of values. Where the second value symbol is generated, the value of the first value symbol and the second value symbol are added together to generate a sum. Finally, settling of the wager occurs depending on whether the first value symbol is or is not within the first predetermined range of values and depending on whether the sum of the first value symbol and the second value symbol is or is not within the second predetermined range of values.

In accordance with a preferred embodiment, the wagering game further includes the steps of continuing a turn of the player by playing another round of the game by the player where the first value symbol is within the first range or the sum of the first and second value symbols is within the second range, and starting of a turn by a second or different player by playing of a round by the second player where the first value symbol generated by the first player is not within the first range or the sum of the first and second value symbols is not within the second range. Preferably, the wagering game still further includes the step of wagering that the first-mentioned player will play a predetermined number of consecutive rounds and/or the step of wagering that the first-mentioned player will generate a first value symbol in the first range for a predetermined number of consecutive rounds.

Also in accordance with a preferred embodiment, the wagering game is played by the player and a house, with the wagering being against the house and with the house selecting the ranges of values and settling of the wagers. In this preferred embodiment, the house also sets up a progressive jackpot which is won by a separate progressive wager. In addition or alternatively, where the house runs a plurality of such wagering games, the house sets up a "link" progressive jackpot among the plurality of wagering games which is won by a progressive wager. With either progressive jackpot, the house continuously adds to the progressive jackpot from the associated wagering game or each of the wagering games of a portion of certain wagers lost. Then, one or more of the players make a progressive wager that the first-mentioned player will generate a first value symbol in the first range for at least a second predetermined number of consecutive rounds, which wager is settled by the house from the appropriate progressive jackpot when this occurs.

In the preferred embodiment, multiple pairs of dice are used as the random value generator, with the activating steps thus including the rolling of different pairs of dice by the player. In addition, the settling of the wager step for the first value symbol includes the step of settling at different predetermined odds depending on the value of the first value symbol generated.

It is an advantage of the present invention that an additive wagering game is provided which is easily understood and quickly learned.

It is also an advantage of the present invention that a wagering game is provided which allows for player participation and secure monitoring.

Other features and advantages of the present invention are stated in or apparent from detailed descriptions of presently preferred embodiments of the invention found hereinbelow.

BRIEF DESCRIPTION OF THE DRAWINGS

The single figure is a schematic top view of a table layout for making of wagers according to the wagering game of the present invention.

DETAILED DESCRIPTION OF THE PREFERRED EMBODIMENTS

With reference now to the drawing in which like numerals represent like elements, an additive wagering game according to the present invention is preferably played in conjunction with a wagering table layout 10 as depicted in the figure. It will be appreciated that there are spots at table layout 10 for seven different players to participate in the wagering game, as evidenced by the seven numbered ante bet indicia 12 located on the three sides of the table layout 10. Of course, the number of players can vary as desired as table layout 10 is exemplary only. A house or host who controls the game is then located at the fourth side of the table. The house or host can be either an individual player, a player/banker, an insurance company, a casino, or any other such entity which controls the game and settles the wagers made (hereafter simply referred to as "house" for convenience). The wagering game utilizes nomenclature from a familiar game to make it easier for the players to follow. In this embodiment, the game of bowling is used as discussed subsequently.

According to the method of the present invention, the outcome of the wagering game is determined by randomly generated value symbols. Obviously, there are many different types of random value generators known in the art, such as pairs of dice 14 having indicia for numbers 1–6 on the respective faces thereof. Suitable pairs of dice 14 are preferably different colors and are shown in the figure as being kept next to the position of the house, except when being used by a player. Besides pairs of dice 14, it will be apparent that other random value generators such as cards, tiles, balls, or a computer are also usable, but dice are preferred due to their familiarity to the wagering public and the sense of participation that such dice provide to the player responsible for throwing the dice each time the game is played. Dice also provided a ready distribution of number values (i.e., seven is the most frequently occurring value, while 2 and 12 are the least frequently occurring values) which adds generally appreciated strategies due to such a distribution to the game as will be apparent from the following.

The method of playing the wagering game requires that various predetermined ranges of values be selected by the house, which correspond to known outcomes of the base game (bowling in this embodiment). For example, when a single pair of dice 14 is rolled (first roll), the preselected ranges are an open range of 2–5, a qualifying range of 6–9, and a strike range of 10–12 which is indicated by indicia in box 16 for all players to easily see. Thus, following the bowling analogy, a roll of the dice in the open range is equivalent to an open frame, a roll of 10–12 is equivalent to a strike frame, and a roll of 6–9 is equivalent to a frame where a second ball is rolled before the outcome of the frame is determined. In the case where a first roll is in the range of 6–9, the player then rolls another (differently colored for convenience) pair of dice 14 to determine the outcome of the frame by a sum of the first and second rolls. Again, a preselected range of values of the sum of the first and second values of the two rolls determines the outcome of the frame. For example, a sum of 8–14 is equivalent to an open frame (similar to a first roll whose value is 2–5) while a sum of 15–21 is equivalent to a spare frame as indicated by indicia in box 18.

Using bowling as the base game, it will thus be appreciated that the wagering game is played in the following manner. Initially, all players are required to place a minimum (and probably a maximum) ante bet at indicia 12 by placing a suitable wagering token thereon. This ante bet is that the player having a turn to throw the dice will either have a round which results in an open frame as depicted by the box with the zero therein or a marked (strike or spare) frame as indicated by the box with the solid spare diagonal and the broken strike cross diagonal. The result of the round played by the player taking a turn is then determined based on the first throw of the pair of dice 14 if that throw is in the range 2–5 (resulting in an open frame) or in the range of 10–12 (resulting in a strike frame). Obviously, if the throw is in one of these ranges, all ante bets are then settled. However, if the throw is in the range of 6–9, the house places the thrown pair of dice 14 inside the box 16 and then the player is handed a second pair of dice 14 which he then rolls. The values of the two pairs of dice 14 are then added together to produce a sum, which sum falls into one of the two ranges, an open range of 8–14 or a spare range of 15–21 so that an outcome of that round (or frame) is similarly thus determined and the ante bet paid off appropriately.

In order to add an additional bet to the game to generate more interest (and hence profits for the house), a variety of additional bets are available for each player to bet on as desired by that player. One such additional bet is simply that the player taking a turn will achieve a strike on that round. This bet is simply indicated by the player placing a wagering token on indicia in box 22 over that player's position number (17). This bet is then won or lost depending on the first throw of the player taking a turn. Obviously, bets could also be made on whether the player taking a turn will throw a value in the open range or the qualifying range.

Also in accordance with the method of playing the wagering game, the turn of a player continues so long as the player continues to achieve either a mark frame or a strike frame each round (i.e., has a first throw in the strike range 10–12, or if the first throw is in the qualifying range of 6–9 then the sum of the second throw added to the first has a value in the spare range of 15–21). When a player has an open frame, the turn of that player is then finished and a new player is selected to take a turn such as the next higher numbered player around table layout 10. By providing this method of play, it is then also possible to wager additional bets on how long a turn of a player will last, the wager being made when the player begins a turn. One additional bet is simply that the player will achieve three marked frames (rounds) in a row. Another additional bet, which can be in addition to or in place of the first-mentioned additional bet, is that the player will achieve three strike frames in a row. Such a bet is evidenced by indicia in box 24 on table layout 10, with the player placing a wagering token over his player number in box 24.

In order to generate even further interest and betting, a progressive jackpot wager can also be provided. In this situation, the house sets up a progressive wagering pool or jackpot for the wagering game which is won by a specified progressive wager. The setting up of the jackpot includes providing for a minimum guaranteed payoff by the house, as well as a predetermined share of the progressive jackpot which increases by adding a (small) portion of each or certain wagers lost at the wagering game to the jackpot so that the jackpot increases until a payoff is made. Obviously, as the size of the jackpot increases, the interest in the jackpot will also increase.

Where the house is other than a player/banker, the house generally has a plurality of wagering games. In this situation, the house alternately (or in addition) sets up a linked progressive wagering pool or jackpot for all of the wagering games so that a predetermined share of this linked jackpot is won by a specified progressive wager at any of the wagering games. The setting up of the linked jackpot similarly includes a minimum guaranteed payoff by the house as well as a predetermined share of the linked jackpot, with a (small) portion of each or certain wagers lost at any linked wagering game then being added to the linked jackpot so that the linked jackpot can become very large and a more attractive wager.

Suitable progressive wagers (either to a linked or non-linked jackpot as desired) are indicated in box 26 by placing a wager on top of the player's position number. For example, one suitable progressive wager, made when a player commences a turn, is that the player will throw three or more strikes in a row; with the payoff increasing for the single bet based on an increasing numbers of strikes being thrown. With the progressive wager, the player is a winner after three strikes are thrown, but the guaranteed winnings are increased for each additional strike thrown after the first three (up to a maximum). Alternatively, the progressive wager can be that the player will throw or mark for three or more consecutive rounds (and thus will have some combination of consecutive strikes or spares in a row). Again, the winnings are increased for increased marks in a row, and the higher winnings further increased by increasing percentages of a progressive jackpot.

For still further interest in the wagering game, the (non-progressive) betting on whether the player will throw a strike on a round can provide a payout which varies depending on which value is rolled to achieve the value in the strike range. Obviously, there would thus be a better payout where the strike is achieved with a value of twelve than with a value of ten.

By way of example, the following payoffs for various noted bets can be used to provide the house with a reasonable (around 5%) take.

| ANTE WAGER | PAYOFF |
|---|---|
| Open (no mark) | 3 to 4 |
| Mark - 1 roll 10 | 1 to 1 |
| - 1 roll 11 | 2 to 1 |
| - 1 roll 12 | 3 to 1 |
| - two rolls | 1 to 1 |
| **ADDITIONAL WAGERS** | **PAYOFF** |
| Strike that round | 5 to 1 (with 5% commission) |
| Three strikes in a row | 200 to 1 |
| Three marks in a row | 10 to 1 |
| **PROGRESSIVE WAGER (marks in a row)** | **PAYOFF** |
| 3 | 3 to 1 |
| 4 | 5 to 1 |
| 5 | 10 to 1 |
| 6 | 15 to 1 |
| 7 | 25 to 1 |
| 8 | 50 to 1 |
| 9 | 100 to 1 |
| 10 | 500 to 1 |
| 11 | 1,000 to 1 |
| 12 | 5,000 to 1 |
| **PROGRESSIVE WAGER (strikes in a row)** | **PAYOFF** |
| 3 | 75 to 1 |
| 4 | 300 to 1 |
| 5 | 1,250 to 1 |
| 6 | 7,500 to 1 |
| 7 | 12,500 to 1 |
| 8 | 125,000 (A) + 5% |
| 9 | 500,000 (A) + 10% |
| 10 | 1,000,000 (A) + 25% |
| 11 | 10,000,000 (A) + 50% |
| 12 | 25,000,000 (A) + 100% |

It will be appreciated that the (A) designation used above means that the guaranteed payoff will only be made in aggregate to all of the players winning that bet during a round regardless of the number of tokens wagered by a player. And that in addition to the guaranteed payoff, the winning players will also receive a designated percentage of the progressive jackpot as part of the payoff. Thus, the sum of the guaranteed payoff and the jackpot percentage will be split equally amongst those players. This is done to prevent a massive payout by the house should one of these designated wagers be won by a number of players at one table when the exceedingly rare occurrence of eight or more strikes in a row happens. For example, seven players at one table all betting and winning the progressive wager where twelve strikes are thrown would share the guaranteed payoff of $25,000,000 plus 100% of the progressive jackpot so that each of the seven players would receive about $3.6 million plus the share of the progressive jackpot; rather than each player winning $25,000,000 and 100% of the progressive jackpot for a total payout of $175,000,000 and seven times the progressive jackpot.

While the wagering game has been described as being based on a bowling game, it will be appreciated that other sport games can also provide a basis for a similar game. Thus other games and events analogous to the mark (strike-spare) vs. open frame of bowling would be: hit (on base-home run) vs. out of baseball, score (touchdown-field goal) vs. no score of football, basket (three point-two point) vs. no basket of basketball, goal (first shot-second shot) vs. no goal of hockey, point (ace-winner) vs. no point of tennis, and par or below (birdie-par) vs. above par of golf. Obviously, other analogies of other sport games are also possible. In addition, besides sport games other games can similarly be used as a basis for the wagering game such as card games, other wagering games, or virtually anything which provides an easy to remember and familiar win/lose categories.

It will also be appreciated that additional wagers besides those mentioned are also possible as desired. For example, instead of wagers that a player will mark three times in a row, the wager could be that three successive players will not mark. In addition, the designation of where the aggregate payoffs commence, and/or where the progressive jackpot payoffs commence and what percentages are paid, can also vary and can also be used with a progressive mark wager or another progressive wager.

Thus, while the present invention has been described with respect to exemplary embodiments thereof, it will be understood by those of ordinary skill in the art that variations and modifications can be effected within the scope and spirit of the invention.

We claim:

1. A method of playing a wagering game where an outcome of the game is determined by randomly generated value symbols comprising the steps of:

providing of a random value symbol generator which is actuatable by a player, the random value symbol generator producing a value symbol which is within a predetermined set of values;

selecting of a first predetermined range of values and of a second predetermined range of values;

playing of a round of the game by the player including the steps of wagering a wager that a first generation of the value symbol will be within the first predetermined range of values resulting in a winning of the wager or that a second generation of the value symbol when added to the first generated value symbol will be within the second predetermined range of values resulting in a winning of the wager, activating the random value symbol generator to produce a first value symbol, activating of the random value symbol generator to produce a second value symbol where the first value symbol is not within the first predetermined range of values, and adding the value of the first value symbol and the second value symbol to generate a sum;

settling of the wager depending on whether the first value symbol is within the first predetermined range of values or depending on whether the sum of the first value symbol and the second value symbol is or is not within the second predetermined range of values.

2. A method of playing a wagering game as claimed in claim 1 and further including the steps of: continuing a turn of the player by playing another round of the game by the player where the first value symbol is within the first range or the sum of the first and second value symbols is within the second range; and starting of a turn by a second player by playing of a round by the second player where the first value symbol generated by the first player is not within the first range or the sum of the first and second value symbols is not within the second range.

3. A method of playing a wagering game as claimed in claim 2 and further including the step of wagering that the first-mentioned player will play for a predetermined number of consecutive rounds by generating value symbols in the first or second ranges each round.

4. A method of playing a wagering game as claimed in claim 2 and further including the step of wagering that the first-mentioned player will generate a first value symbol in the first range for a predetermined number of consecutive rounds.

5. A method of playing a wagering game as claimed in claim 2 wherein the wagering game is played by the player and a house;

wherein said wagering step includes the step of wagering against the house; and wherein said selecting steps include the selecting of the ranges of values by the house and said settling step includes the step of settling of the wager by the house.

6. A method of playing a wagering game as claimed in claim 5 and further including the steps of setting up a progressive jackpot which is won by a progressive wager, adding continuously to the progressive jackpot of a portion of certain wagers lost, making of a progressive wager by a player that the first-mentioned player will generate value symbols in at least one range for at least a predetermined number of consecutive rounds, and settling of the progressive wager by the house from the progressive jackpot when the first-mentioned player has generated value symbols in the at least one range for the at least predetermined number of consecutive rounds or the turn of the first-mentioned player ends before the first-mentioned player has generated value symbols for the predetermined number of consecutive rounds.

7. A method of playing a wagering game as claimed in claim 5 wherein said playing step includes the running of a plurality of wagering games by the house;

further including the steps of setting up a progressive jackpot among the plurality of wagering games which is won by a progressive wager, adding continuously to the progressive jackpot from each of the wagering games of a portion of certain wagers lost, making of a progressive wager by a player that the first-mentioned player will generate value symbols in at least one range for at least a predetermined number of consecutive rounds, and settling of the progressive wager by the house from the progressive jackpot when the first-mentioned player has generated value symbols for the at least predetermined number of consecutive rounds or the turn of the first-mentioned player ends before the first-mentioned player has generated value symbols for the predetermined number of consecutive rounds.

8. A method of playing a wagering game as claimed in claim 5 wherein said settling of the wager step for the first value symbol includes the step of settling at different predetermined odds depending on the value of the first value symbol generated.

9. A method of playing a wagering game as claimed in claim 5 wherein said providing step includes the providing of multiple pairs of dice as the random value generator and said activating steps include the rolling of different pairs of dice by the player.

10. A method of playing a wagering game where an outcome of the game is determined by randomly generated value symbols comprising the steps of:

providing of a random value symbol generator which is actuatable by a player, the random value symbol generator producing a value symbol which is within a predetermined set of values;

selecting of a first predetermined range of values, of a second predetermined range of values, and of a third predetermined range of values, the first, second and third ranges of values including all of the predetermined set of values;

selecting of a fourth predetermined range of values equal to the second range of values plus a portion of the set of values and of a fifth predetermined range of values equal to the second range of values plus a remainder of the set of values;

playing of a round of the game by the player including the steps of wagering a wager (1) that a first generation of the value symbol will be within the first predetermined range of values or if the first generation is within the second predetermined range of values that a second generation of the value symbol when added to the first generated value symbol will be within the fourth range of values, or (2) that the first generation of the value symbol will be within the third predetermined range of values or if the first generation is within the second predetermined range of values that the second generation of the value symbol when added to the first generated value symbol will be within the fifth range of values, activating the random value symbol generator to produce a first value symbol, activating of the random value symbol generator to produce a second value symbol if the first value symbol is within the second predetermined range of values, and adding the value of the first value symbol and the second value symbol to generate a sum;

settling of the wager after the generation of the first value symbol depending on whether the first value symbol is within the first predetermined range of values or the third range of values; and settling of the wager if the first value symbol is within the second range of values depending on whether the sum of the first value symbol and the second value symbol is within the fourth predetermined range of values or the fifth predetermined range of values.

11. A method of playing a wagering game as claimed in claim 10 and further including the steps of: continuing a turn of the player by playing another round of the game by the player where the first value symbol is within the first range or where the sum of the first and second value symbols is within the fourth range; and starting of a turn by a second player by playing of a round by the second player where the first value symbol generated by the first player is within the third range or where the sum of the first and second value symbols is within the fifth range.

12. A method of playing a wagering game as claimed in claim 11 and further including the step of wagering that the first-mentioned player will play a predetermined number of consecutive rounds.

13. A method of playing a wagering game as claimed in claim 11 and further including the step of wagering that the first-mentioned player will generate a first value symbol in the first range for a predetermined number of consecutive rounds.

14. A method of playing a wagering game as claimed in claim 10 wherein the wagering game is played by the player and a house;

wherein said wagering step includes the step of wagering against the house; and wherein said selecting steps include the selecting of the ranges of values by the house and said settling steps include the steps of settling of the wager by the house.

15. A method of playing a wagering game as claimed in claim 14 and further including the steps of setting up a progressive jackpot which is won by a progressive wager, adding continuously to the progressive jackpot of a portion of certain wagers lost, making of a progressive wager by a player that the first-mentioned player will generate value symbols in at least one of the ranges for at least a predetermined number of consecutive rounds, and settling of the progressive wager by the house from the progressive jackpot when the first-mentioned player has generated value symbols for at least the predetermined number of consecutive rounds depending on the number of consecutive rounds or the turn of the first-mentioned player ends before the first-mentioned player has generated value symbols for the predetermined number of consecutive rounds.

16. A method of playing a wagering game as claimed in claim 14 wherein said playing step includes the running of a plurality of wagering games by the house;

further including the steps of setting up a progressive jackpot among the plurality of wagering games which is won by a progressive wager, adding continuously to the progressive jackpot from each of the wagering games of a portion of certain wagers lost, making of a progressive wager by a player that the first-mentioned player will generate value symbols in at least one range for at least a predetermined number of consecutive rounds, and settling of the progressive wager by the house from the progressive jackpot when the first-mentioned player has generated value symbols for at least the predetermined number of consecutive rounds depending on the number of consecutive rounds or the turn of the first-mentioned player ends before the first-mentioned player has generated value symbols for the predetermined number of consecutive rounds.

17. A method of playing a wagering game as claimed in claim 10 wherein said settling of the wager step for the first value symbol includes the step of settling at different predetermined odds depending on the value of the first value symbol generated.

18. A method of playing a wagering game as claimed in claim 10 wherein said providing step includes the providing of multiple pairs of dice as the random value generator and said activating steps include the rolling of different pairs of dice by the player.

19. A method of playing a wagering game as claimed in claim 10 wherein said selecting steps include the selecting of values 10–12 as the first predetermined range of values, of values 6–9 as the second predetermined range of values, of values 2–5 as the third predetermined range of values, of values 15–21 as the fourth predetermined range of values, and of values 8–14 as the fifth predetermined range of values.

* * * * *